US011648173B2

(12) United States Patent
Gagliano et al.

(10) Patent No.: US 11,648,173 B2
(45) Date of Patent: May 16, 2023

(54) PHYSICAL THERAPY MASSAGE BALL DEVICE

(71) Applicant: KC2, LLC, Covington, LA (US)

(72) Inventors: Kristie Gagliano, Covington, LA (US); Christy Peachey, Mandeville, LA (US)

(73) Assignee: KC2, LLC, Covington, LA (US)

( * ) Notice: Subject to any disclaimer, the term of this patent is extended or adjusted under 35 U.S.C. 154(b) by 701 days.

(21) Appl. No.: 16/109,494

(22) Filed: Aug. 22, 2018

(65) Prior Publication Data

US 2019/0046393 A1 Feb. 14, 2019

Related U.S. Application Data

(63) Continuation of application No. PCT/US2017/019335, filed on Feb. 24, 2017.

(60) Provisional application No. 62/299,647, filed on Feb. 25, 2016.

(51) Int. Cl.

| | |
|---|---|
| ***A61H 15/00*** | (2006.01) |
| ***A61H 11/00*** | (2006.01) |
| ***A61H 39/04*** | (2006.01) |
| ***A61H 7/00*** | (2006.01) |

(52) U.S. Cl.

CPC ..... *A61H 15/0092* (2013.01); *A61H 7/003* (2013.01); *A61H 11/00* (2013.01); *A61H 15/00* (2013.01); *A61H 39/04* (2013.01); *A61H 2015/0042* (2013.01); *A61H 2201/0207* (2013.01); *A61H 2201/0214* (2013.01); *A61H 2201/0257* (2013.01); *A61H 2201/1253* (2013.01); *A61H 2201/1635* (2013.01); *A61H 2201/1654* (2013.01); *A61H 2205/081* (2013.01); *A61H 2205/12* (2013.01); *A61H 2205/125* (2013.01)

(58) Field of Classification Search

CPC .... A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071; A61H 15/00; A61H 15/0078; A61H 15/0085; A61H 15/0092; A61H 7/003

See application file for complete search history.

(56) References Cited

U.S. PATENT DOCUMENTS

| | | | |
|---|---|---|---|
| 4,796,616 | A | 1/1989 | Panahpour |
| 5,545,456 | A | 8/1996 | Suida |
| 5,577,996 | A | 11/1996 | Gardner et al. |
| 5,628,772 | A | 5/1997 | Russell |
| 5,736,213 | A | 4/1998 | Meier |
| 2003/0144616 | A1 | 7/2003 | Henderson |
| 2003/0176264 | A1 | 9/2003 | Burns |

(Continued)

*Primary Examiner* — LaToya M Louis

(74) *Attorney, Agent, or Firm* — Blynn L. Shideler; Krisanne Shideler; BLK Law Group

(57) ABSTRACT

A physical therapy massage ball device includes an elongated tubular sleeve having a massage ball receiving cavity defined between the ends of the sleeve, at least one massage ball, and generally two to six massage balls, received within the massage ball receiving cavity, and a pair of handles extending from each end of the massage ball receiving cavity. The massage ball receiving cavity may include an opening for the user to selectively add or remove massage balls from the massage ball receiving cavity. The tubular sleeve may be formed from elastic material such as spandex and be used to form both the massage ball receiving cavity and the handles.

18 Claims, 5 Drawing Sheets

(56) References Cited

U.S. PATENT DOCUMENTS

| | | | |
|---|---|---|---|
| 2004/0006292 | A1 | 1/2004 | Joseph |
| 2004/0243035 | A1 | 12/2004 | Devlin |
| 2007/0055187 | A1 | 3/2007 | Magnone |
| 2009/0192423 | A1 | 7/2009 | Halmos |
| 2013/0085426 | A1 | 4/2013 | Brodsky |

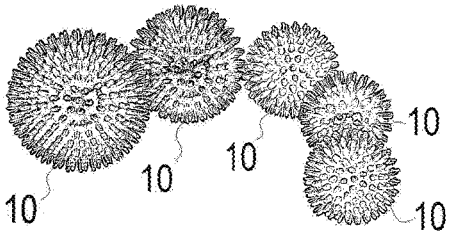
FIG. 1
PRIOR ART
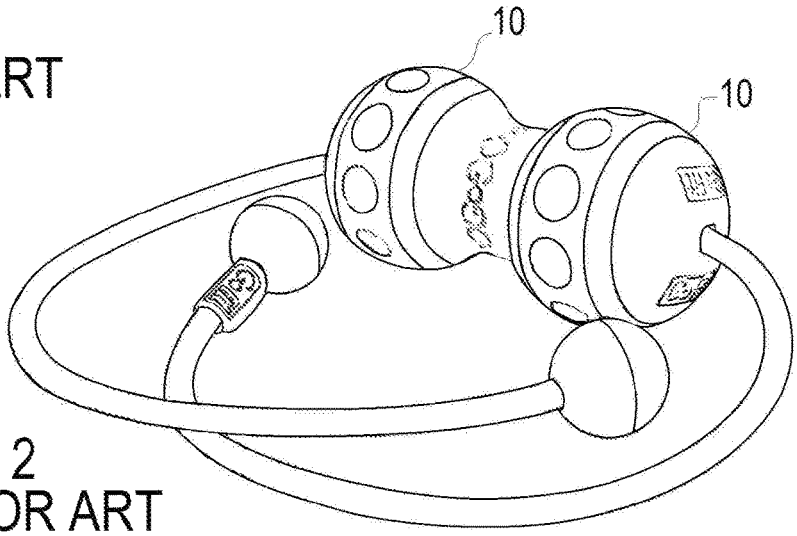
FIG. 2
PRIOR ART
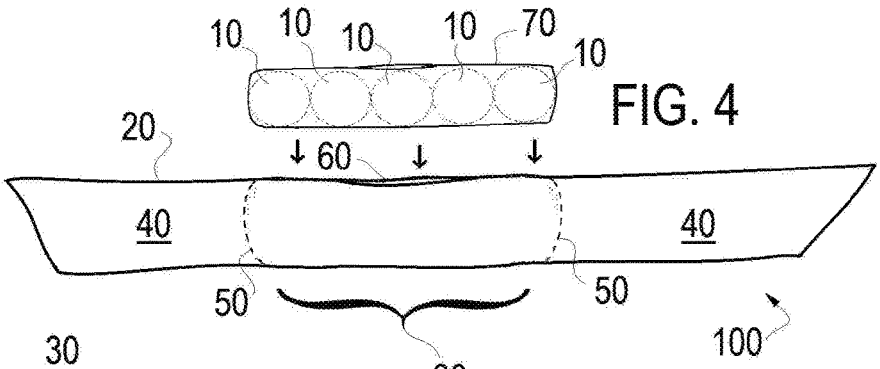
FIG. 4
FIG. 3
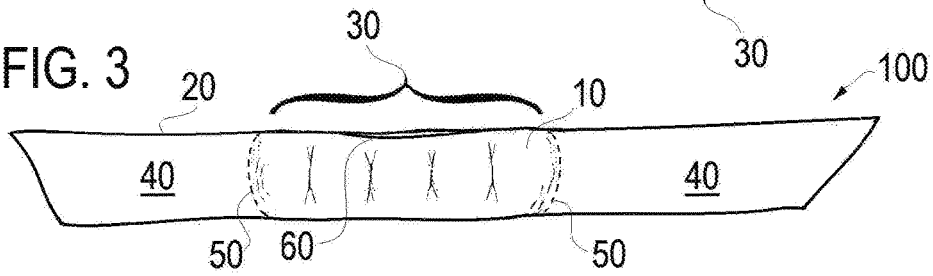

100

FIG. 7
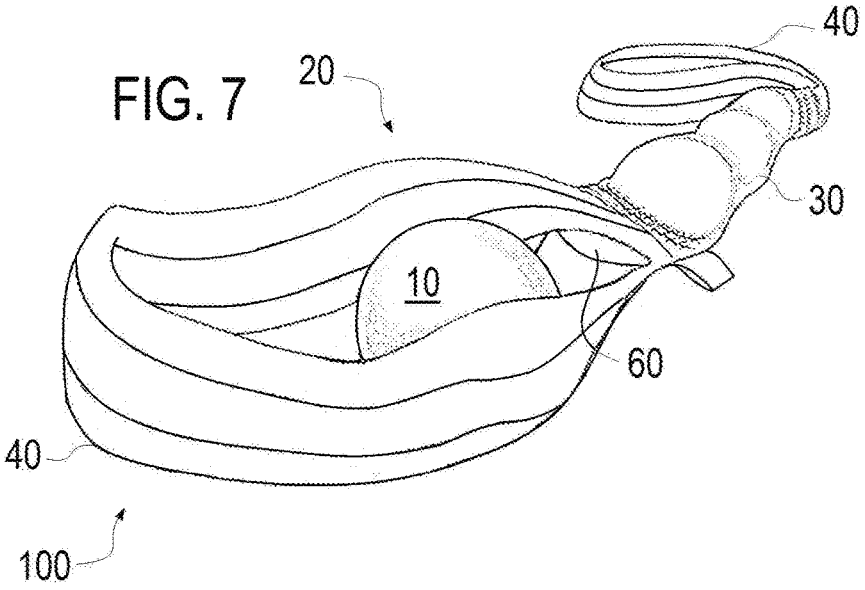
FIG. 8
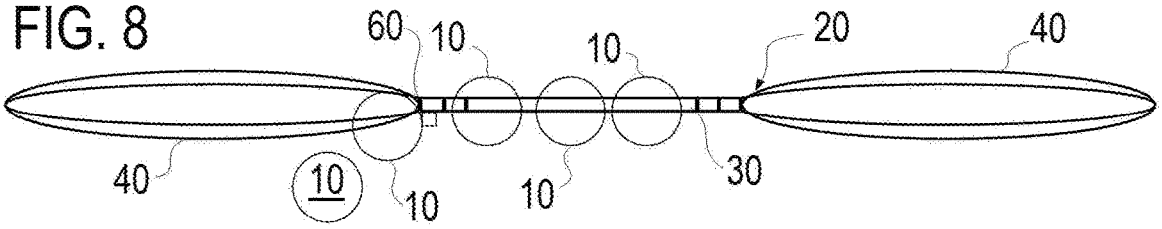
FIG. 9
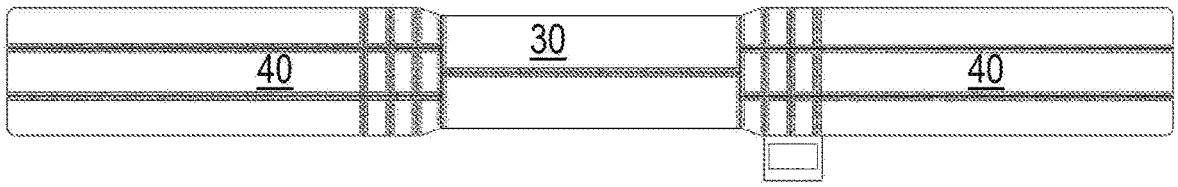
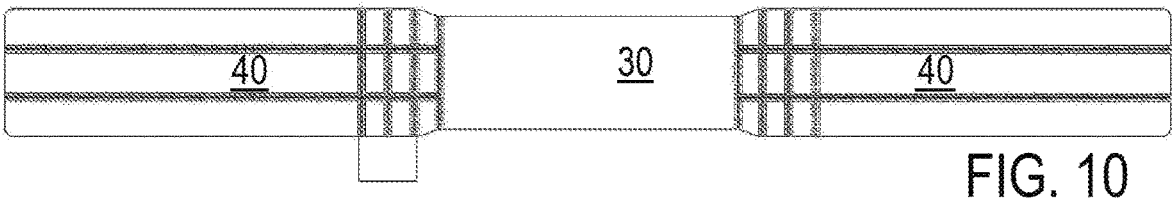
FIG. 10

PHYSICAL THERAPY MASSAGE BALL DEVICE

RELATED APPLICATIONS

This application is a continuation of International Patent Application Serial Number PCT/US17/19335 filed Feb. 24, 2017 and which published as publication WO2017-147409 on Aug. 31, 2017, which application and publication are incorporated herein by reference. International Patent Application Serial Number PCT/US17/19335 claims priority to U.S. provisional patent application Ser. No. 62/299,647 filed Feb. 25, 2016 entitled "Physical Therapy Massage Ball Device," invented by Christy Peachey and Kristie Gagliano.

BACKGROUND OF THE INVENTION

Field of the Invention

The present invention relates to physical therapy massage ball devices.

Background Information

Massage is one of the oldest and simplest forms of medical care. Egyptian tomb paintings show people being massaged. A Chinese book from 2,700 B.C., *The Yellow Emperor's Classic of Internal Medicine*, recommends 'breathing exercises, massage of skin and flesh, and exercises of hands and feet" as the appropriate treatment for—complete paralysis, chills, and fever." Massage therapy was one of the principal method of relieving pain for Greek and Roman physicians. Julius Caesar was said to have been given a daily massage to treat neuralgia. "The physician must be experienced in many things," wrote Hippocrates, the father of Western medicine, in the 5th century B. C., "but assuredly in rubbing . . . for rubbing can bind a joint that is too loose, and loosen a joint that is too rigid." Ayurveda, the traditional Indian system of medicine, places great emphasis on the therapeutic benefits of massage with aromatic oils and spices.

Doctors such as Ambroise Pare, a 16th-century physician to the French Court, praised massage as a treatment for various ailments. Swedish massage, the method most familiar to Westerners, was developed in the 19th century by a Swedish doctor, poet, and educator named Per Henrik Ling. Dr. Ling's system was based on a study of gymnastics and physiology, and on techniques borrowed from China, Egypt, Greece, and Rome. Physiotherapy, originally based on Ling's methods, was established with the foundation in 1894 of the Society of Trained Masseurs. During World War I patients suffering from nerve injury or shell shock were often treated with massage. St. Thomas's Hospital, London, had a department of massage until 1934. Massage is now used in intensive care units, for children, elderly people, babies in incubators, and patients with cancer, AIDS, heart attacks, or strokes. Most American hospices have some kind of bodywork therapy available, and it is frequently offered in health centers, drug treatment clinics, and pain clinics.

A variety of massage techniques have also been incorporated into several other complementary therapies, such as aromatherapy, sports performance massage, reflexology (concentrating on application of pressure to areas on the feet, hands and ears), Rolfing (a form of alternative medicine originally developed by Ida Rolf (1896-1979) as Structural Integration), Hellerwork (a system involving deep tissue massage and exercise, designed to help correct posture, improve mobility, relieve pain, etc.), acupressure (based life energy flowing through "meridians" in the body with physical pressure applied to acupuncture points to clear blockages in these meridians), deep tissue massage (deeper pressure focused is on the deepest layers of muscle tissue, tendons and fascia), trigger point massage (alleviates the source of the pain in trigger points through cycles of isolated pressure and release), Myofascial release (or MFR—soft tissue therapy for the treatment of skeletal muscle immobility and pain), neck curve restoration, and osteopathy.

A number of devices have been developed to assist in massage therapies. One commonly utilized physical therapy device is known as a massage ball. FIG. 1 illustrates a set of AEROMAT® brand Massage Balls 10 designed for massage and sensory therapy, representing conventional massage balls 10. These balls 10 are configured "to ease away tension and release muscles throughout the body" using various methods. The massage balls 10 offer stimulation feedback while relaxing a subject's fingers, legs, feet, neck and back. This brand of moderately firm sensory balls 10 come in a variety of sizes, namely 6 cm (2.4"), 7 cm (2.8"), 8 cm (3.1"), 9 cm (3.5"), 10 mm (4"), and 15 cm (16"). Similar balls 10 are sold under the AKU™ mark, the CANDO® mark, the FITBALL® mark, the GAIAM® mark, the GOFIT® mark, the JOLLYGEAR™ mark, the MANDALA YOGA™ mark, the PRO-TEC® mark, the SKLZ ACCU-POINT™ mark, the SPRI® mark and the TRIGGER-POINT™ mark. These brands collectively represent an overview of the state of the art of massage balls 10, which knowledge is well known to those of ordinary skill in the art of this application and evidence such balls 10 come in a variety of sizes (diameters) with a variety of surfaces (smooth, ribbed, projections) and weights or densities/durometer (generally references as ranging from soft to firm or hard).

The patent literature also has some relevant background information. For example, U.S. Pat. No. 4,796,616 discloses a physical therapy massage device comprising a plurality of balls mounted vertically and horizontally within a framework.

U.S. Pat. No. 5,545,456 discloses a wash cloth that cleans and massages with a plurality of pockets along the length for the insertion of soap or massage balls U.S. Pat. No. 5,577,996 discloses physical therapy massage device comprising a hand held ridged rod with two spherical masses mounted thereon.

U.S. Pat. No. 5,628,772 discloses a thermal and massage treatment therapeutic device comprising a pouch filled with a plurality of spherical balls formed of a "thermal transfer" material for primarily migraine sufferers to roll gently against their eyes.

U.S. Publication 2003/0144616 discloses a physical therapy massage ball device comprising an elongated sac with two freely moveable tennis balls therein.

U.S. Publication 2004/0243035 discloses a physical therapy massage ball device comprising a tubular sleeve housing a pair of tennis balls.

U.S. Publication 2004/0006292 discloses physical therapy massage ball device comprising a tubular sleeve housing one or more massage balls 10. This publication fails to provide adequate handle mechanism for the device.

U.S. Publication 2007/0055187 discloses a physical therapy massage ball device comprising a carrier with two compartments each fixedly holding a massage ball 10 to address the deficiencies of a freely moveable massage ball 10 devices of the prior art.

U.S. Publication 2009/0192423 discloses a physical therapy massage ball device comprising an elongated strap carrier with spaced separate pockets for massage balls 10.

U.S. Publication 2013/0085426 discloses a physical therapy massage device comprising first and second coupled rollers within a central sleeve component.

In some of the above discussed prior art relating to use of massage balls 10, there has been some difficulty in maintaining the massage balls 10 in the desired location on the subject during a given therapy, particularly in certain back locations. In addressing this problem some have designed elongated roller configurations for massage devices to assist in device placement. FIG. 2 illustrates a solution to this particular problem offered by the makers of the GOFIT® brand which describe this as "2 massage ball on a rope targets sore muscles for pain-relief. Part of GoFit's Muscle Pain Management system, the Trigger Ball relieves knots, trigger points and muscle soreness. Dual cords help to reach your back, shoulders, gluts, legs and other spots in need of deep-tissue massage while keeping the balls in place." The handholds of this device of FIG. 2 do assist in maintaining the working element (the two "balls" 10) in the desired location but this solution is limited to the particulars of the working element shape and size and is thus limited in its application. The, at least previously commercially available, mobility ball sac from Crossover Symmetry provides a central receiving pouch for attempting to properly locate massage balls 10.

With this background it becomes clear that there remains to provide simple, effective efficient therapy devices.

SUMMARY OF THE INVENTION

The present invention addresses the deficiencies of the prior art and provides an elongated member having a massage ball receiving cavity defined between the ends of the member, at least one massage ball received within the massage ball receiving cavity, and a pair of handles extending from each end of the massage ball receiving cavity.

Alternatively the present invention may be defined as providing a physical therapy massage ball device including a massage ball receiving cavity defined within an elongated elastic member with an opening for the user to selectively add or remove massage balls from the massage ball receiving cavity; between two and five massage balls selectively received within the massage ball receiving cavity; and a pair of elastic handles extending from each end of the massage ball receiving cavity.

These and other advantages are described in the brief description of the preferred embodiments in which like reference numeral represent like elements throughout.

BRIEF DESCRIPTION OF THE DRAWINGS

FIG. 1 is a perspective view of a set of prior art massage balls;

FIG. 2 is a perspective view of a prior art massage ball device with handles;

FIG. 3 is a perspective view of a physical therapy massage ball device according to one embodiment of the present invention;

FIG. 4 is an exploded schematic perspective view of the physical therapy massage ball device of FIG. 3;

FIG. 7 is a perspective view of a physical therapy massage ball device according to a second embodiment of the present invention;

FIG. 8 is a schematic side view of the physical therapy massage ball device according to FIG. 7;

FIG. 9 is a top plan view of the physical therapy massage ball device according to FIG. 7, with the balls omitted; and FIG. 10 is a top plan view of the physical therapy massage ball device according to FIG. 7, with the balls omitted.

DESCRIPTION OF THE PREFERRED EMBODIMENTS

Massage Ball Device 100

Figure 5A:
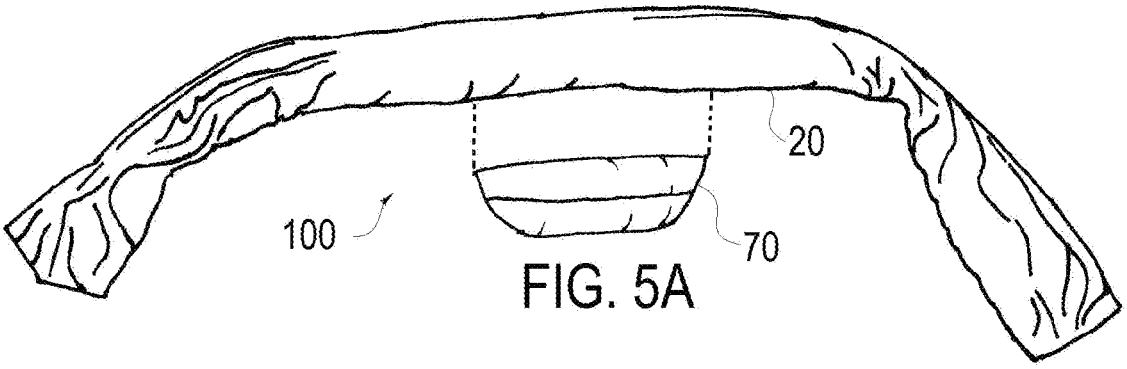
FIGS. 5A and 5B are perspective views of the components of the physical therapy massage ball devices of FIG. 3.
Figure 5B:
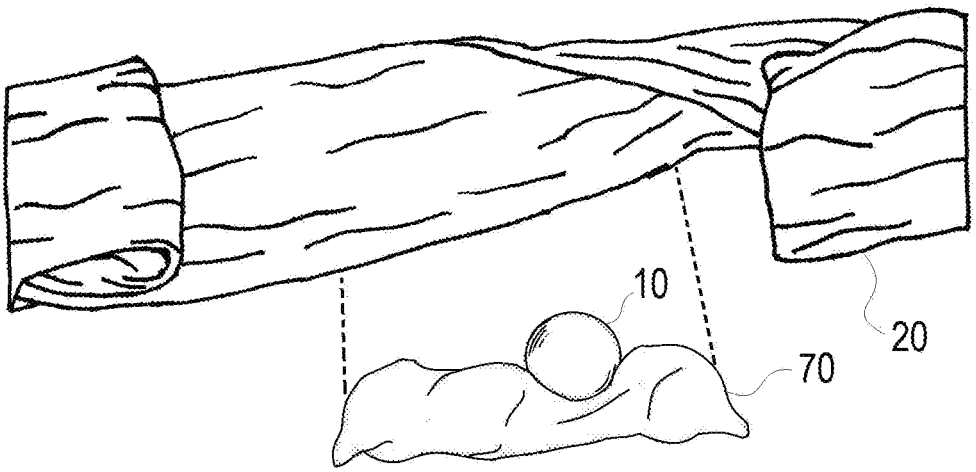

Referring to FIGS. 3-10, a physical therapy massage ball device 100 according to the present invention generally comprises an elongated member 20 having a massage ball receiving cavity 30 defined between the ends of the member 20, with at least one massage ball 10, generally 1-8, often 2-6, received within the massage ball receiving cavity 30, and a pair of handles 40 extending from each end of the massage ball receiving cavity 30.

The present invention is described as a physical therapy device 100, but the category of treatment and associated device moniker may fall into other broad nomenclatures, some of which are described below for illustration. For example this may be called a massage device, a rehabilitation device, a mobility device, a pain management tool, a sports injury rehabilitation tool. The procedure itself may also have many names such as massage therapy, rehabilitation, pain management, and the like.

Figure 6A:
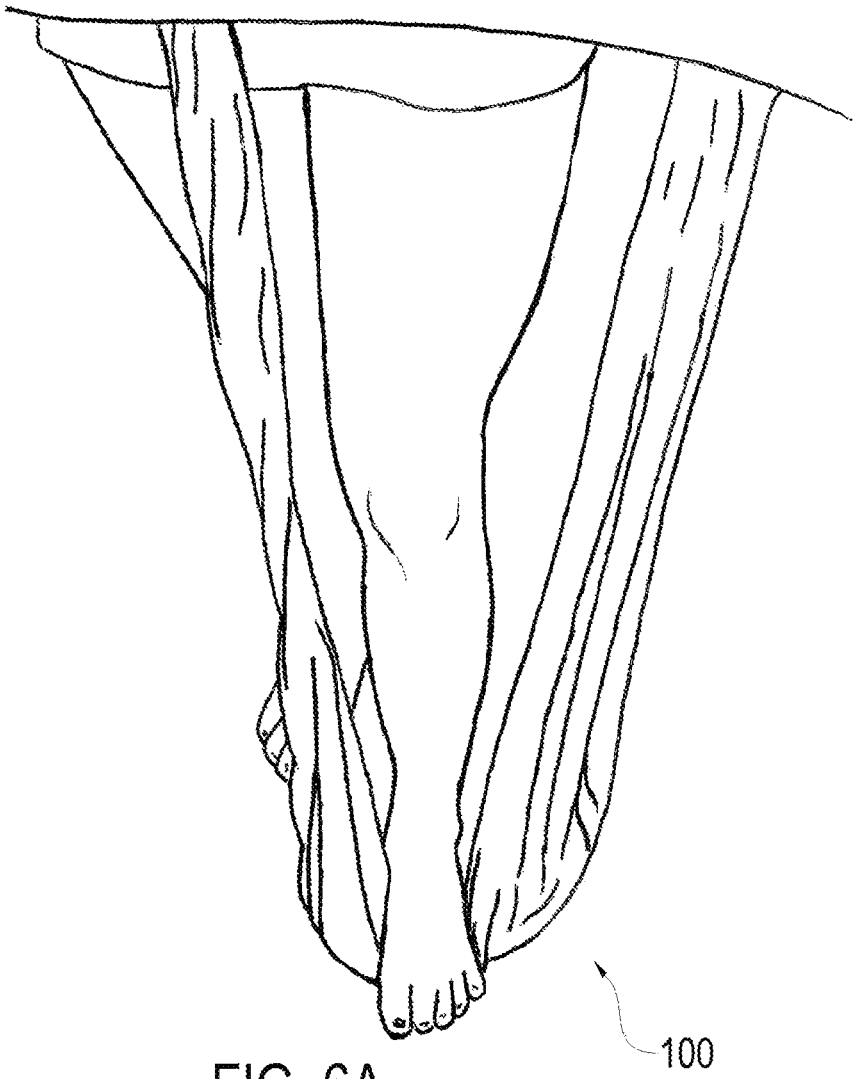
FIGS. 6A and 6B are illustrate distinct uses of the physical therapy massage ball device of FIG. 3.
Figure 6B:
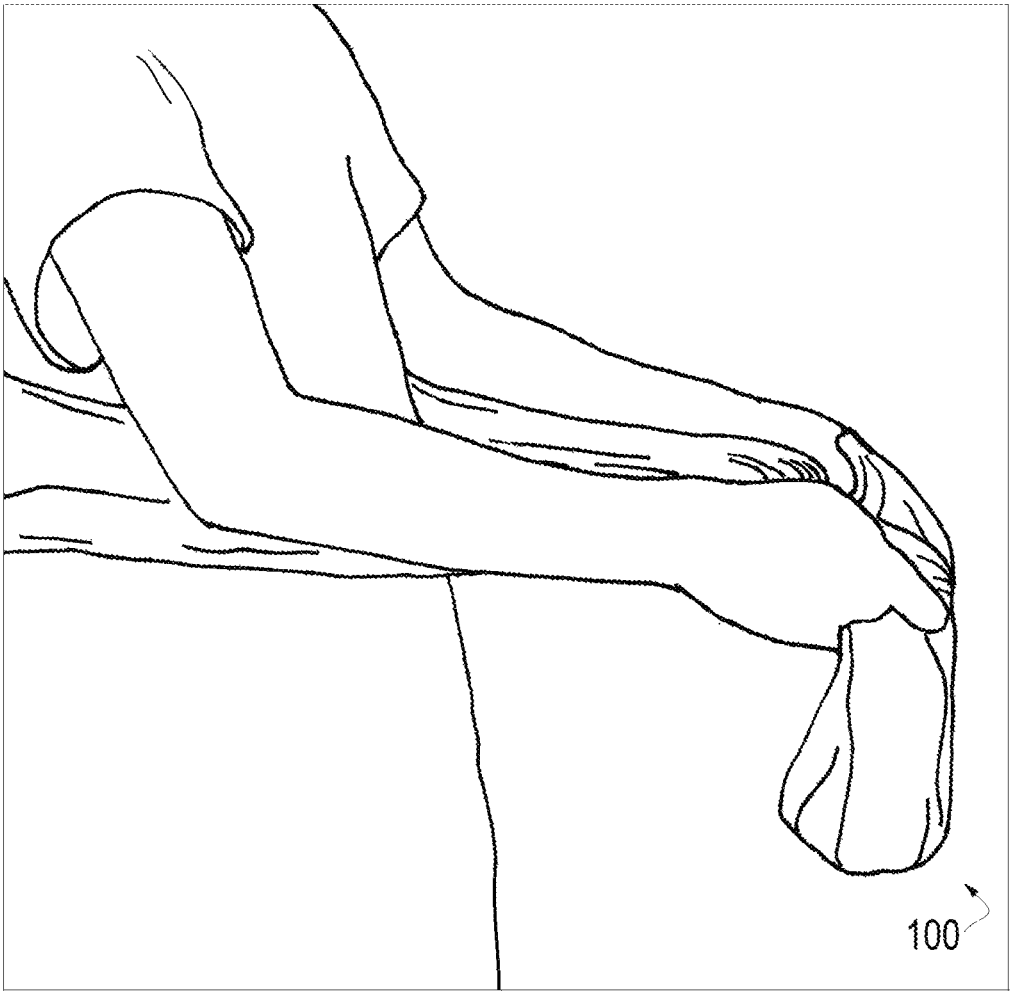

The general concept of the present invention is that the handles 40 allow for proper placement, control and/or manipulation of the balls 10 by the subject 10 or the administrator/therapist during therapy. For example with the device 100 the therapist may position the balls 10 in the desired location (on the back as shown in FIG. 6B or under a foot as shown in FIG. 6A) to work on the desired tissue/pressure point, and the subject may be given the handles 40 to hold onto and to pull sufficiently to maintain the balls 10 in the designated location throughout the therapy.

The desired location may move throughout the therapy, for example the subject may move the handles 40 along his/her torso during the therapy to move the balls 10 along a segment of the subject's back during therapy. The handles 40 may be utilized only at the beginning, for example when the therapist places the balls 10 in a desired location the subject may utilize the handles 40 to hold them in place only while the subject is moving into position against the ground or supporting wall in which position the balls 10 are firmly secured by pressure between the subject and the ground or wall.

In the embodiment shown in FIGS. 1-6 the elongated member 20 is formed as a single tubular sleeve which may be effectively formed from spandex material, such as a poly-nylon spandex blend. Spandex, or elastane, is a synthetic fiber known for its exceptional elasticity. Spandex is stronger and more durable than natural rubber. It is a polyester-polyurethane copolymer that was invented in 1958 by chemist Joseph Shivers at DuPont's Benger Laboratory in Waynesboro, Va. When introduced in 1962, this material revolutionized many areas of the clothing industry, and is ubiquitous in the sports arena. The name "spandex" is an anagram of the word "expands", and spandex is the preferred name for the material in North America, while in continental Europe it is referred to by variants of "elastane."

The poly-nylon spandex blend is a fabric incorporating polyester fibers, nylon fibers and spandex fibers. The nylon fibers yield the strength desired for the sleeve forming member 20 of FIGS. 1-6.

Nylon is a generic term for a family of synthetic polymers, technically aliphatic or semi-aromatic polyamides. Like spandex, nylon can trace its roots to Dupont as this synthetic material was originally developed by Wallace Carothers at the Dupont Chemical Company originally in the 1930s. Nylon fibers are now the second most common fiber used in the United States.

The tubular sleeve forming member 20 in FIGS. 1-6 also forms each of the pair of handles 40 extending from each end of the massage ball receiving cavity 30. This is easily accomplished by the provision of seams 50 extending across the tubular sleeve forming the member 20 in FIGS. 1-6 at opposed ends of the massage ball receiving cavity 30 to define the cavity 30 and maintain the balls 10 within the cavity 30.

The massage ball receiving cavity 30 includes an opening 60 for selectively inserting and removing massage balls 10. The massage balls 10 utilized may be any known type desired by the user/therapist. In the embodiment shown in FIGS. 3-4 the device 100 may be marketed with a set of four or six firm smooth surfaced 65 mm diameter massage balls 10, generally the device 100 is designed for 1-8 balls 10. With the receiving cavity 30 formed of an elastic material such as spandex, the opening 60 can be formed slightly smaller than the desired largest size of massage balls 10 contained within the cavity 30. The opening allows the user (subject or therapist) to selectively add or remove massage balls 10 from the cavity 30.

The physical therapy massage ball device 100 according to invention may be formed of a variety of sizes to accommodate a different maximum number of balls 10 within the cavity 30, and of a different range of ball 10 diameters. However, the embodiment shown in FIGS. 1-6, has the massage ball receiving cavity 30 configured to selectively receive up to eight 65 mm diameter massage balls 10. The 65 mm diameter massage balls 10 are effectively the size of lacrosse balls, which may and have been utilized as firm smooth surfaced massage balls 10 in the art.

The physical therapy massage ball device 100 allows the user/therapist to simply and easily alter the number of massage balls 10 used in any therapy, as well as altering the desired surface texture of the balls 10 used in any therapy and the hardness/durometer of the balls 10 for the desired therapy. In this manner the device 100 yields great flexibility and a large number of therapy applications.

As shown in FIG. 4, and in FIGS. 5A and B, the balls 100 within the cavity 30 may optionally be held within their own holding sack 70, such as a mesh bag. The sack 70 with balls 10 may be inserted into the cavity 30, alternatively the desired balls 10 may be removed from the sack 70 to be inserted directly into the cavity 30. The sack 70 may effectively increase the range of diameters of balls 10 associated with any one device 100 as the sack 70 can allow smaller diameters of balls 10 to be used with a given device 100 than would otherwise be practical. In certain embodiments of the device 100 the cavity 30 may be designed for a single ball 10 or a pair of balls 10 of a designated size, and when the balls 10 of this size are used with such a cavity 30, there is no need for the sack 70.

The length of handles 40 should be sufficient to be easily grasped by the user/therapist in all desired therapies and a total length of device of about 36" has proven effective, however the elastic nature of the handles 40 allows this to be device 100 to effectively form an "exercise" or resistance band for the subject. Allowing the handles 40 to be long enough for the device 100 to form a conventional resistance band can add further flexibility to the device 100 increasing the therapies and exercises that may be accommodated with the device 100.

FIGS. 7-10 illustrate an alternative construction of the device 100 in which the elongated member 20 having a massage ball receiving cavity 30 is formed as a sleeve only for the cavity 30, whereas the handles 40 are formed from straps doubled over or looped around to connect to the cavity 30. The opening 60 is formed between the looped straps forming one of the handles 40. This configuration is designed to receive up to three balls. Although the manufacture of the device 100 of FIGS. 7-10 is different the operation is essentially the same, however the looped handles 40 of this embodiment give improved holding options not available in the embodiment of FIGS. 1-6, and thus this embodiment adds some functionality to the device 100

The device 100 is particularly well suited as a massage tool for a number of distinct massage types and applications only some of which are discussed herein.

Deep Tissue Trigger Point Massage Device 100

The device 100 is effective as a deep tissue trigger point massager. Deep tissue massage therapy is similar to Swedish massage, but the deeper pressure is beneficial in releasing chronic muscle tension. The focus is on the deepest layers of muscle tissue, tendons and fascia (the protective layer surrounding muscles, bones and joints). A study in the Journal of Alternative and Complementary Medicine found that people's blood pressure fell after a single 45 to 60 minute deep tissue massage. Additionally, a 2010 meta-analysis in the Journal of Clinical Psychiatry found that massage modalities like deep tissue reduce stress hormone levels and heart rate while boosting mood and relaxation by triggering the release of oxytocin and serotonin. A trigger point is a tight area within muscle tissue that causes pain in other parts of the body. A trigger point in the back, for example, may produce referral pain in the neck. The neck, now acting as a satellite trigger point, may then cause pain in the head. The pain may be sharp and intense or a dull ache. Trigger point massage therapy is specifically designed to alleviate the source of the pain through cycles of isolated pressure and release. The results and benefits of trigger point massage are releasing constricted areas in the muscles thus alleviating pain. The balls 10 of the device 100 act to facilitate trigger point therapy as acting as points of isolated pressure, which if used regularly can help naturally manage pain and stress from chronic injuries. The advantages of the device 100 is the ability to One particular example of deep tissue massage for the treatment of plantar fasciitis. There is a thick connective tissue that runs the entire length of the bottom of the human foot. It starts on the five toes and extends to the bottom of the heel. This tissue is known as the plantar fascia. While running, runners land on the heels of the feet and then raise themselves on the toes before shifting the weight onto the other foot. This causes the plantar fascia to come under strain and when the strain becomes too much, the plantar fascia is likely to tear. Even if there is no tearing the strain can be felt and is an indication of plantar fasciitis. Mountain climbers, aerobics practitioners, and hikers can also become afflicted by plantar fasciitis due to constant strain on the plantar fascia during their exertions. Plantar fasciitis can also be caused by using the wrong footwear. Deep Tissue Massage is a technique that concentrates on the deeper muscle tissues by applying deep pressure on the fascia, Achilles heel, and calf muscles through slow strokes. A ball 10 or ball pair within the cavity 30 of the device 100 allows for effective therapy and the muscle fibers can be followed or pressure can be applied across tendons. Deep tissue massage with device 100 can help to release the muscle tension, break scar tissue, and lead to its elimination. It concentrates on specific areas, leading to soreness before and after the massage, yet the results are definite and can be felt within just a couple of days. Deep tissue massage with the device 100 loosens the muscle tissues, remove muscle toxins, and ensure proper circulation of blood and oxygen which had been affected by plantar fasciitis. Deep tissue massage works because it physically breaks down the adhesions that are formed by muscle tissues in the muscles caused by over exertion or strain.

Acupressure Device 100

Acupressure [from Latin acus "needle" (see acuity)+ pressure (n.)] is an alternative medicine technique similar in principle to acupuncture. It is based on the concept of life energy which flows through "meridians" in the body. In treatment, physical pressure is applied to acupuncture points with the aim of clearing blockages in these meridians. Traditionally pressure may be applied by hand, by elbow, or with various devices. Some medical studies, the methodology of which has been questioned by some, have suggested that acupressure may be effective at helping manage nausea and vomiting, for helping lower back pain, tension headaches, and stomachache, among other things. Whether the provable medical claims of acupressure can extend beyond the known benefits of massage therapy is not critical for this implementation, as the device 100 of the present invention yields an effective device to pursue the advantages of acupressure. Traditionally the "acuball" is a small ball made of rubber with protuberances that is heatable. It is used to apply pressure and relieve muscle and joint pain. The energy roller is a small cylinder with protuberances. It is held between the hands and rolled back and forth to apply acupressure. The foot roller (also "krupa chakra") is a round, cylindrical roller with protuberances. It is placed on the floor and the foot is rolled back and forth over it. The device 100 of the present invention effectively replaces all of these prior acupressure application devices. Further the balls 10 of the present invention may be heated in the same manner as the known acuball and deliver the same heat treatment from within the cavity 30 (they may also be cooled for cryotherapy treatment). A plurality of the balls 10 within the cavity 30 can replace both the energy roller and the foot roller for acupressure applications.

Reflexology Device 100

Reflexology is the application of pressure to areas on the feet, hands and ears. Reflexology is generally relaxing and may be an effective way to alleviate stress. The theory behind reflexology is that these areas correspond to organs and systems of the body. Several studies funded by the National Cancer Institute and the National Institutes of Health indicate that reflexology may reduce pain and psychological symptoms, such as anxiety and depression, and enhance relaxation and sleep. Studies also show that reflexology may have benefits in palliative care of people with cancer. Proponents believe that pressure applied to these areas affects the organs and benefits the person's health. Reflexologists use foot charts to guide them as they apply pressure to specific areas. Sometimes these practitioners use items, such as rubber balls, rubber bands and sticks of wood, to assist in their work. The device 100 is an effective tool for reflexologists to utilize as the balls 10 concentrates and isolates the pressure and the device 100 can assist in proper placement to the desired reflexology area.

Myofascial Release Device 100

Myofascial release (or MFR) is a soft tissue therapy for the treatment of skeletal muscle immobility and pain. This alternative medicine therapy aims to relax contracted muscles, improve blood and lymphatic circulation, and stimulate the stretch reflex in muscles. In 1976, Janet G. Travell, and American physician and medical researcher, began using the term "myofascial trigger point" and in 1983 published the reference *Myofascial Pain & Dysfunction: The Trigger Point Manual*. The phrase has also been loosely used for different manual therapy techniques, including soft tissue manipulation work such as connective tissue massage, soft tissue mobilization, foam rolling, and strain—counter-strain techniques. The device 100 can effectively operate in place of existing "back roll" device used in these techniques with balls 10 better concentrating the desired treatment pressure.

Sports Performance Device 100

Sports massage therapy plays a number of roles in improving sports performance and decreasing the risk of injury by increasing range of motion, assisting with soft tissue recovery, and increasing circulation and nourishment in muscle tissue. A 15-30 minute session before performing athletic activities will raise the body temperature and increase range of motion. If necessary, a therapist can focus on the area that will require exertion during the athletic activity. Therapeutic massage within an hour after the activity will help relieve muscle cramps, reduce edema by restoring the natural blood and lymph flow, and speed up the recovery process. A Sports massage is sometimes referenced as a combination of Swedish and deep-tissue with assisted stretching techniques to improve the range of motion of the joints used in a client's particular sport, however elements of trigger point massage (deep, focused compression with some stretching to release the injured segment of muscle fiber) are also present. The device 100 is particularly well suited to provide deep and focused pressure via the balls 10 for this application. The device 100 thus can be effectively incorporated into sports massage programs used for muscle maintenance and sports performance for athletes.

Neck Curve Restoration Device 100

A straight or even reversed neck curve is among the main reasons for neck pain signs and symptoms as well as degenerative changes in the cervical spine. Combined with forward head posture, the muscle groups in the neck as well as upper back need to contract gradually stronger as the curve of the neck gets worse. The elevated muscle force required to maintain the forward head posture will increase compression of structures in the neck, resulting in disc and joint deterioration. The device 100 with properly placed balls 10 may facilitate stretching for the straight or reversed cervical curve as well as simultaneously being capable of working the key muscle groups of the neck as well as upper back to strengthen and maintain the correction. This involves the discs, joints, ligaments, as well as muscles. The neck curve exercise with device 100 should be utilized every day to get the best results in neck curve restoration, making the affordability and ease of use of the device 100 a great tool.

Sleep Positioning Therapy Device 100

Snoring is known to cause sleep deprivation to snorers (and those around them!), as well as daytime drowsiness, irritability, lack of focus and decreased libido. It has also been suggested that it can cause significant psychological and social damage to sufferers. Multiple studies reveal a positive correlation between loud snoring and risk of heart attack (about +34% chance) and stroke (about +67% chance). Though snoring is often considered a minor affliction, snorers can sometimes suffer severe impairment of lifestyle. A U.S. study estimates that roughly one in every 15 Americans is affected by at least a moderate degree of sleep apnea. One method of treating the condition is having the subject sleep on their side to prevent the tongue from blocking the throat. Sometimes a device is coupled to the back of the subject to encourage the subject to maintain a side sleeping posture. In this context, the device 100 may be fastened around the waist of the user by tying handles 40 together, alternatively snaps or buckles may be added to or included with the handles 40 to facilitate the coupling. The balls 10 will be placed in the middle of the user's back and prompt the user to maintain sleeping on his side. The noninvasive device 100 yields a simple solution to facilitate this treatment that is effective for some persons.

Cryotherapy and Thermotherapy Device 100

The heating or cooling of the balls 10 allows the device 100 to be effectively used in thermal treatments, which represents some of the oldest muscle treatments known (as old as massage therapy). Thermotherapy consists of application of heat or cold (cryotherapy) for the purpose of changing the cutaneous, intra-articular and core temperature of soft tissue with the intention of improving the symptoms of certain conditions. Cryotherapy and thermotherapy are useful adjuncts for the treatment of musculoskeletal injuries and soft tissue injuries. Using cooling or heat as a therapeutic intervention decreases pain in joint and muscle as well as soft tissues and they have opposite effects on tissue metabolism, blood flow, inflammation, edema and connective tissue extensibility. Thermotherapy can be used in rehabilitation facilities or at home. The device 100 can combine thermotherapy or cryotherapy with other treatments discussed above making the device 100 incredibly versatile.

Alternative Applications

The above listing are merely a few application in which the device 100 effectively replaces existing devices (sometimes multiple devices) with the advantages described above relating to precise ball placement and precise application of the desired pressure (and application of heat or cold) at the designated position. This is not exhaustive of the applications of the device 100 which can be used for back rehabilitation, neck rehabilitation, preventative therapies and a host of other applications.

The preferred embodiments described above are illustrative of the present invention and not restrictive hereof. It will be obvious that various changes may be made to the present invention without departing from the spirit and scope of the invention. The precise scope of the present invention is defined by the appended claims and equivalents thereto.

What is claimed is:

1. A physical therapy massage ball device comprising an elongated elastic member having a massage ball receiving cavity with a pair of massage ball cavity ends defined within the member, at least one massage ball received within the massage ball receiving cavity, and a pair of handles extending from each end of the massage ball receiving cavity, wherein the elastic member is formed as a tubular sleeve which forms each of the pair of handles extending from each end of the massage ball receiving cavity, and wherein the elongated elastic member is long enough and flexible enough whereby the massage ball receiving cavity may be positioned beneath a foot of a straight leg of a user with the pair of handles extending past the user's waist.

2. The physical therapy massage ball device according to claim 1 wherein the elastic member is formed of spandex material, and wherein a total length of the device is about 36".

3. The physical therapy massage ball device according to claim 1 wherein the massage ball receiving cavity is configured to selectively receive up to six massage balls each having a diameter of about 65 mm diameter.

4. The physical therapy massage ball device according to claim 3 wherein the massage ball receiving cavity includes an opening for selectively inserting and removing massage balls, wherein the opening is less than 65 mm in diameter, and wherein a total length of the device is about 36".

5. The physical therapy massage ball device according to claim 1 wherein the massage ball receiving cavity is formed by seams extending across the tubular sleeve at opposed ends of the massage ball receiving cavity.

6. A physical therapy massage ball device comprising:

a massage ball receiving cavity defined centrally within an elastic member with an opening for the user to selectively add or remove massage balls from the massage ball receiving cavity;

between one and eight massage balls selectively received within the massage ball receiving cavity; and wherein the elastic members also forms a pair of handles extending from each end of the massage ball receiving cavity and wherein the elastic member is long enough and flexible enough whereby the massage ball receiving cavity may be positioned beneath a foot of a straight leg of a user with the pair of handles extending past the user's waist.

7. The physical therapy massage ball device according to claim 6 wherein a tubular sleeve forms each of the pair of handles extending from each end of the massage ball receiving cavity, and wherein a total length of the device is about 36".

8. The physical therapy massage ball device according to claim 7 wherein the tubular sleeve is formed of spandex material.

9. The physical therapy massage ball device according to claim 6 wherein the massage ball receiving cavity is configured to selectively receive up to eight 65 mm massage balls.

10. The physical therapy massage ball device according to claim 9 wherein the opening is less than 65 mm.

11. The physical therapy massage ball device according to claim 6 wherein each handle is formed as a loop coupled to the massage ball receiving cavity.

12. A physical therapy massage ball device comprising:

a massage ball receiving cavity defined centrally within an elastic tubular sleeve with an opening for the user to selectively add or remove massage balls from the massage ball receiving cavity;

at least three massage balls selectively received within the massage ball receiving cavity; and wherein the elastic tubular sleeve also forms a pair of handles extending from each end of the massage ball receiving cavity and wherein the elastic tubular sleeve is long enough and flexible enough whereby the massage ball receiving cavity may be positioned beneath a foot of a straight leg of a user with the pair of handles extending past the user's waist.

13. The physical therapy massage ball device according to claim 12 wherein the tubular sleeve is formed of spandex material, and wherein a total length of the device is about 36".

14. The physical therapy massage ball device according to claim 13 wherein the massage ball receiving cavity is configured to selectively receive up to eight 65 mm massage balls.

15. The physical therapy massage ball device according to claim 14 wherein the opening is less than 65 mm.

16. The physical therapy massage ball device according to claim 13 wherein the massage ball receiving cavity is formed by seams extending across the tubular sleeve at opposed ends of the massage ball receiving cavity.

17. The physical therapy massage ball device according to claim 12 wherein each handle is formed as a loop coupled to the massage ball receiving cavity.

18. The physical therapy massage ball device according to claim 17 wherein the massage ball receiving cavity is formed by seams extending across the tubular sleeve at opposed ends of the massage ball receiving cavity.

* * * * *